US007273429B2

(12) United States Patent
Watson et al.

(10) Patent No.: US 7,273,429 B2
(45) Date of Patent: Sep. 25, 2007

(54) BALL GAME DEVICE

(76) Inventors: Ken Watson, 65 Circle Circle, Dalkeith (AU) 5009; Elma McSherry, deceased, late of Scotland (AU); Represented by Gerard McSherry, 227 Bank Street, Irvine, Ayrshire, KA12 OYB, Scotland (GB)

( * ) Notice: Subject to any disclaimer, the term of this patent is extended or adjusted under 35 U.S.C. 154(b) by 133 days.

(21) Appl. No.: 10/415,051

(22) PCT Filed: Oct. 20, 2001

(86) PCT No.: PCT/AU01/01386

§ 371 (c)(1),
(2), (4) Date: Apr. 23, 2003

(87) PCT Pub. No.: WO02/34340

PCT Pub. Date: May 2, 2002

(65) Prior Publication Data

US 2004/0048697 A1 Mar. 11, 2004

(30) Foreign Application Priority Data

Oct. 27, 2000 (GB) ..... 0026267.5
May 4, 2001 (GB) ..... 0110966.9

(51) Int. Cl.
*A63B 59/00* (2006.01)

(52) U.S. Cl. ..... 473/527; 473/516; 473/524; 473/463; 473/464

(58) Field of Classification Search ..... 473/516, 473/518, 524, 527, 551, 463, 464, 525
See application file for complete search history.

(56) References Cited

U.S. PATENT DOCUMENTS

| | | | | | |
|---|---|---|---|---|---|
| 1,930,281 | A | * | 10/1933 | Ogden | 473/525 |
| 2,987,316 | A | * | 6/1961 | Butera | 473/518 |
| 3,186,714 | A | * | 6/1965 | Berendt et al. | 473/505 |
| 5,027,439 | A | * | 7/1991 | Spector | 2/20 |
| 5,080,374 | A | * | 1/1992 | Yu | 473/514 |
| 5,236,191 | A | * | 8/1993 | Capriati | 473/463 |
| 5,549,294 | A | | 8/1996 | Wellen et al. | |
| 5,827,207 | A | * | 10/1998 | MacMorran | 602/5 |
| 5,839,979 | A | * | 11/1998 | De Genty | 473/464 |
| 2002/0098923 | A1 | * | 7/2002 | Reynolds et al. | 473/518 |
| 2003/0130074 | A1 | * | 7/2003 | Petroskey | 473/463 |
| 2004/0048697 | A1 | * | 3/2004 | Watson et al. | 473/518 |

FOREIGN PATENT DOCUMENTS

| | | | | |
|---|---|---|---|---|
| DE | 156982 | * | 9/1939 | 473/FOR. 190 |
| DE | 833311 | * | 7/1949 | 473/FOR. 174 |
| FR | 2695834 | * | 3/1994 | 473/FOR. 168 |
| GB | 2 030 871 A | | 4/1980 | |
| NL | 7605224 | * | 9/1977 | 473/FOR. 190 |

OTHER PUBLICATIONS

Derwent Abstract Accession No. 90-122179/16, SU 1512638A (Khark Rail Transp) Oct. 7, 1989.

* cited by examiner

*Primary Examiner*—Raleigh W. Chiu
(74) *Attorney, Agent, or Firm*—Gregory N. Clements

(57) ABSTRACT

A ball game device comprising a body 10 adapted to receive a hand 24 and a wrist 25 of a user 26, the body 10 presenting two hitting surfaces 14 for hitting a ball 20. The body 10 comprises two panels 12 with a cavity 22 therebetween for receiving the hand 24 and wrist 25 through an opening 23. The device may also be supplied in kit form.

25 Claims, 17 Drawing Sheets

BALL GAME DEVICE

FIELD OF THE INVENTION

The present invention relates to a ball game device used particularly, but not exclusively, for teaching and learning general co-ordination for racket sports as a precursor to the use of a conventional handled racket.

The device can also be used as leisure equipment or as a toy, having a strong "fun" element. In addition, the device can be used as a physical education training aid (for example, in schools) or as a piece of games apparatus for the disabled or those in rehabilitation.

BACKGROUND ART

For a young child to learn a racket sport, the first obstacle to overcome is that of general co-ordination. The acquisition of the skills required to experience a racket sport as a fulfilling activity requires the development of a high level of neuromuscular co-ordination. Holding a racket and making it connect with a ball to project it with the desired direction and speed is a complex skill which is difficult to learn, especially for a young child. A child learning to do this needs to learn in a way that is not too advanced, which could lead to frustration, and also in a way that will be stimulating so that the child does not get bored.

At present, equipment for teaching children and allowing them to learn elementary co-ordination and racket skills includes miniature rackets, most commonly made of plastic and provided with soft sponge balls. These rackets feature short handles, which facilitate easier control of the ball than in an adult-size racket because the racket head is nearer the hand of the user in the case of miniature rackets.

Miniature rackets are also lighter than adult-size rackets, thus making it easier in some cases for children to use them. However, difficulties have been encountered with some of these rackets where a shorter handle has been combined with a racket head which is almost as large as that of an adult racket. This resulting imbalance or heaviness in the head impedes learning, in particular the correct learning of basic racket skills. The relative heaviness of the racket head leads a young child to "drop" the wrist, instead of keeping it in the "cocked" position, and to use rotation at the wrist joint to generate racket head speed during stroke execution.

There are many toy products on the market not based on traditional racket design but which require catching and hitting skills for their enjoyment. For example, an option on the market is an arrangement where two discs are supplied with a furry ball. One side of the discs is covered in VELCRO or "suckers" to which the ball adheres, and the other side is supplied with a strap for holding the disc to a hand on its palm side. This device helps a child improve basic catching skills.

The designs of these currently available learning aids have some shortcomings some of which have been noted above. Another disadvantage of a previously available learning aid is that a child still has to learn how to hold a miniature racket correctly whilst at the same time developing the skills of hand-eye coordination. It can be difficult to learn these skills simultaneously.

It is an aim of the present invention to facilitate the development of improved methods of teaching and learning general co-ordination and in particular stroke production skills for racket sports.

DISCLOSURE OF THE INVENTION

The present invention provides a ball game device comprising a body adapted to receive a hand and a wrist of a user, the body presenting a first hitting surface and a second hitting surface, for hitting a ball, the second hitting surface opposed to the first hitting surface, and the body being configured to accommodate the hand and wrist of the user between the first hitting surface and the second hitting surface when the device is in use, to at least partly restrict movement of the wrist.

The first or each hitting surface is preferably defined by a panel. The panel typically comprises a first panel defining the first hitting surface and a second panel defining the second hitting surface. The first and second panels are preferably substantially planar.

Either one or both of the panels are preferably conformed to the shape of a racket head so as to simulate a racket and thereby assist in teaching of a racket sport. The two panels may be differently coloured or marked to facilitate learning of forehand and backhand strokes. Either one or both of the panels may be conformed to the size of a conventional racket head such as a squash or tennis racket head so that the or each panel extends beyond the hand and wrist of the user.

Furthermore, a cavity is preferably defined within the body to receive the hand and the wrist of the user. The cavity may be configured as a mitt or a glove and the cavity is preferably dimensioned so that the hand and the wrist of the user are positioned between the panels when the hand and the wrist are received in the cavity. The cavity may also be dimensioned in such a way that it can receive not only the hand and the wrist but also a portion of the forearm adjacent the wrist so that the hand, the wrist and the forearm adjacent the wrist are positioned between the panels.

The or each panel typically comprises an inner face and an outer face, the or each outer face presenting the hitting surface to hit the ball.

Further, the or each panel usually comprises an inner layer and an outer layer, the outer layer comprising the outer face and the inner layer comprising the inner face. The outer layer is preferably comprised of a rigid material for striking the ball and the inner layer is preferably comprised of a flexible material to conform to the shape of the hand. Conveniently, the rigid material may be cardboard and/or plastic such as moulded plastic. The flexible material may be foam.

Preferably, the first panel and the second panel are connected in spaced apart relationship to define the cavity therebetween.

The device may further comprise connection means for connecting the two panels together. The connection means may be adapted to maintain the panels in spaced apart relationship and to enable adjustment of the distance between the panels to provide a firm but comfortable fit on the hand and wrist.

The connection means is preferably positioned on the inner face of the first panel and may be adapted for connection to the second panel in an arrangement to allow an opening in the cavity between the first and second panels for insertion of the hand. In an alternative arrangement, the connection means may be positioned on both the first and second panels to allow joining of the panels in a suitable way.

In some arrangements, the connection means conveniently comprises a plurality of spacers positioned around the periphery of the inner face of the first panel.

Where convenient, the connection means may comprise a snap-fit connector.

In one arrangement, the connection means is preferably hinged to the inner face of the or each panel for pivotal movement between an operative and a stored condition.

The inner face of the panels may further comprise a flange of rigid material bounding the inner layer to present a solid surface on which to attach the connection means and to assist in retaining the inner layer in a secure arrangement. Conveniently the flange may be connected to the outer layer which is also formed of rigid material.

The connection means preferably comprises a set of first connection elements on the first panel and a set of second connection elements on the second panel, the first and second connection elements preferably being adapted to be connected together to connect the first and second panels together in spaced apart relationship to define the cavity.

The first connection elements may be pivoted between operative and stored conditions and the second connection elements can be similarly pivoted. Pivoting of the connection elements to the stored condition allows the connection elements to lay flat in approximate parallel arrangement with the panels for ease of storage.

The spacers may be dimensioned so that a first end of the first panel is maintained at a first distance from a first end of the second panel and so that a second end of the first panel is maintained at a second distance from a second end of the second panel, the second distance being greater than the first distance. This formation creates a tapering effect which allows the device to conform to the shape of a hand.

The opening between the first and second panels is positioned at the second ends of the first and second panels so that the device tapers towards the first ends of the first and second panels.

The or each outer face of the panels may be bounded by a raised periphery thus simulating a racket head.

The connection means may comprise hinge means and a means for drawing the panels together about the hinge. Typically the latter means comprises an adjustable strap system such as an elastic strap. In this form of the invention, the elastic strap allows the panels to move apart to a distance appropriate to accommodate the size of the hand and wrist of the user. In this way, one form of the device may accommodate hands and wrists of differing sizes.

The device may be supplied in kit form.

The kit typically comprises:

material for forming the panels and spacers;

a template for cutting out the panels and spacers; and instructions for assembly of the device.

The kit may further comprise instructions for games to be played with the device. Alternatively, instructions may be provided as a separate item from the kit.

The instructions may be in book, CD-rom, video or internet-based form.

The kit may also comprise a ball or balls for use with the device.

The present invention also provides instructions for games to be played with a ball game device comprising a body adapted to receive a hand and a wrist of a user, the body presenting a first hitting surface and a second hitting surface for hitting a ball, the second hitting surface opposed to the first hitting surface.

The present invention also provides a ball game device comprising a substantially racket-head shaped device adapted to fit over a user's hand and wrist in a glove-like manner to provide a teaching device for racket sports which moves directly with the hand and wrist to allow the user readily to hit the ball.

The device may comprise two panels which are conjoined at a first end by a hinge and at a second end by an elastic strap, the construction allowing the user to slide a hand and wrist in a glove-like manner between the two panels.

The device is ideally light-weight and safe for a child to use. To assist in safety aspects, the device typically has rounded edges and not sharp edges.

In one form of the invention, the kit may comprise:

thirty 5 mm (0.20 inch) thick cardboard pieces, including two rectangular pieces of width 22 cm (8.66 inches) and length 30 cm (11.81 inches) (from which are cut the panels of the device), and twenty-eight strips of width 2 cm (0.787 inches) and length 6 cm (2.363 inches) (the spacers of the device);

an instruction booklet for assembly of the device;

a template for cutting out the panels of the device and for positioning of the spacers; and instructions for games to be played with the device.

The ball game device of the invention provides an easy method for a child to develop the hand-eye coordination and agility required for racket sports. The learning of the proper racket grip is delayed due to the fact that the device does not comprise a handle. The beginner can master the hand-eye coordination required for a racket sport using the device of the invention before at a later stage learning the process of the racket grip. Thus, the device of the invention is designed to encourage the adoption of the correct stroking technique.

Hand-eye coordination skills are easier to develop using the device when compared to using miniature or adult-sized rackets. This is partly due to the fact that there is a reduced distance from the eyes to the point of impact with the ball in the case of the device when compared to miniature or adult-sized rackets. There is also a greatly reduced distance from the point of application of the hitting force, that is the point at which the hand "holds" the device, and the impact point with the ball in the case of the device of the invention as compared to miniature or adult-sized rackets.

A further benefit of the invention is that the panels of the device extend over the wrist of the user which encourages proper use of the arm in a swing movement and also encourages proper orientation and movement of the wrist. The rigid nature of the outer layer of the panels assists in preventing movement of the wrist in a plane perpendicular to the plane of the palm (or back) of the hand, resulting in the user adopting the preferred stroke technique by encouraging movement of the arm from the shoulder. The user's hand is held substantially flat to restrict movement of the wrist and to develop the correct orientation of the hand, wrist, forearm and upper arm during stroke production.

BRIEF DESCRIPTION OF THE DRAWINGS

The invention will be better understood by reference to the following description of several specific embodiments as shown in the accompanying drawings, in which.

BEST MODE(S) FOR CARRYING OUT THE INVENTION

Figure 1:
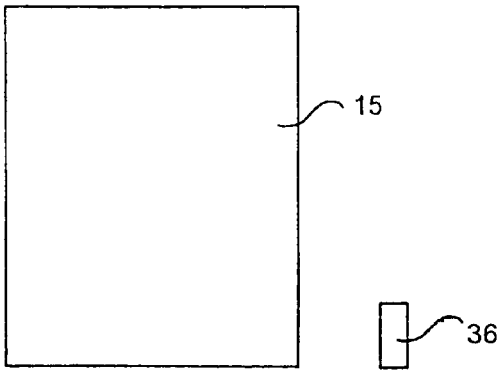
FIG. 1 shows the supplied pieces of card of a first embodiment of the present invention.

Referring now to the drawings, the device of the invention comprises a body generally shown by numeral 10. The body comprises two panels 12 which present hitting surfaces 14 for striking a ball 20. A cavity 22 is present between the panels 12 for receiving a hand 24 and wrist 25 of a user 26 by means of an opening 23.

Each panel is formed of an inner layer 28 and an outer layer 30. The panels further comprise an inner face 32 and an outer face 34.

Connection means 35 are provided to join the two panels 12 together which are in the form of spacers 36 in the first embodiment. The connection means can also be in the form of first connection elements 38 and second connection elements 40 as shown in the case of the third to sixth embodiments.

Figure 2:
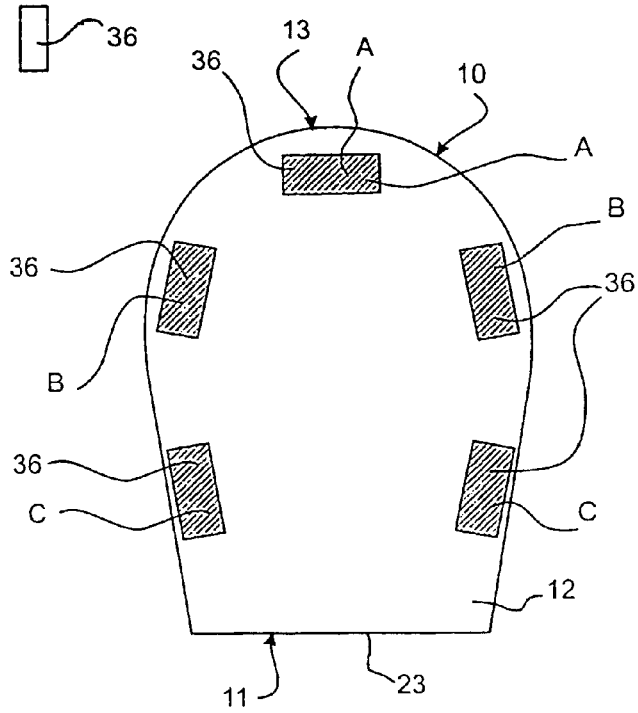
FIG. 2 is a plan view of the first embodiment of the present invention showing how the spacers are arranged on a first panel of the device.

Referring to the first embodiment illustrated in FIGS. 1 to 4, two panels 12 of appropriate shape are cut out of the cardboard piece 15. Spacers 36 in the form of a number of cardboard pieces are attached to the panels 12 using sticky tape in an arrangement as shown in FIG. 2. This arrangement allows one end 11 of the device to be open for insertion of a hand 24 and wrist 25 through the opening 23 whilst the other end 13 is partly closed off by the spacers 36.

Figure 3:
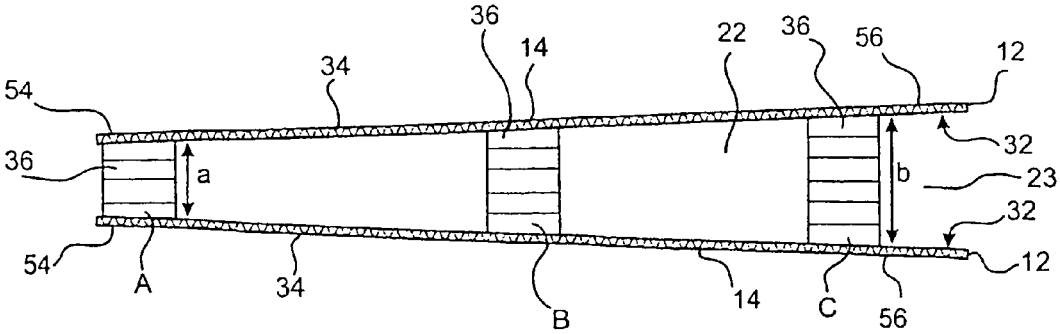
FIG. 3 shows a side view of the device of the first embodiment of the present invention.

As can be seen in FIG. 3, varying numbers of cardboard pieces forming the spacers 36 can be used to adjust the spacing between the panels 12 to accommodate hands and wrists of varying sizes. For example, as seen in FIGS. 2 and 3, four spacers 36 are positioned at A, five spacers 36 are positioned at B and six spacers 36 are positioned at C.

Fewer spacers 36 are positioned at first ends 54 of the panels 12 than at second ends 56 of the panels 12 so that the body 10 tapers towards the first ends 54 of the panels. This results in the cavity 22 being wider at the opening 23 of the device than at the front or first end. Thus distance b is greater than distance a in FIG. 3. This tapering allows for accommodation of the hand 24 and wrist 25 since the tapering mimics the shape of the hand.

The device of the first embodiment is provided in an unassembled, kit form comprising cardboard 15 and cardboard spacers 36. Instructions are provided as to how to assemble the device together with a template for cutting out the panels 12. The kit also includes an instruction booklet describing various games which may be played with the device.

Construction of the device of the first embodiment from cardboard provides an inexpensive, easy-to-use device that can be readily produced on a large scale, for example for use by schools, racket sport coaching organisations, recreation centres and other similarly interested bodies. The assembly of the device can also be used as an art and craft project following which children can use the assembled device for play.

Figure 4A:
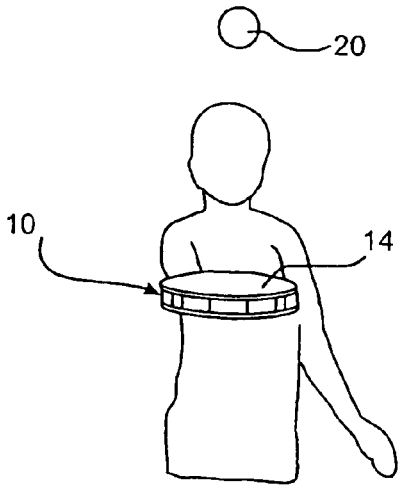
FIGS. 4*a*, 4*b*, 4*c* and 4*d* show a child playing in various ways with the device of the first embodiment.
Figure 4B:
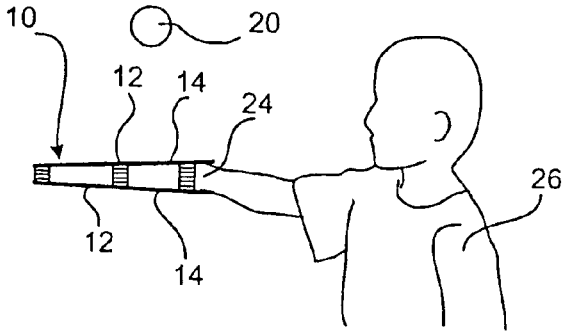
Figure 4C:
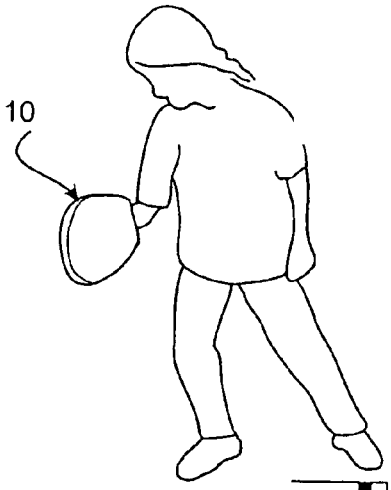
Figure 4D:
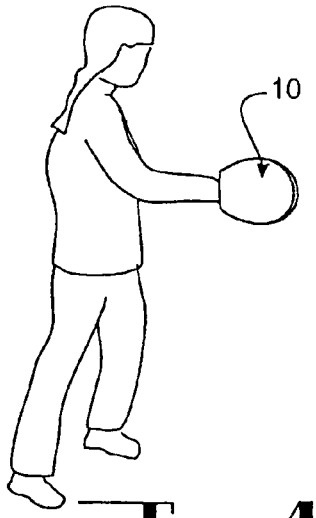

FIGS. 4*a* to 4*d* show a user 26 using the device of the first embodiment. As can be seen, the device can be used for a forehand movement (FIG. 4*c*) and a backhand movement (FIG. 4*d*). The device can also be used to practice upward hitting of the ball 20 on either of the two panels 12 by turning of the hand to present one of the two striking faces 14 to the ball as appropriate as shown in FIGS. 4*a* and 4*b*. Drawings such as FIGS. 4*a* to 4*d* together with additional games are included in an instruction booklet relating to the device.

The second embodiment as shown in FIGS. 5 to 10 comprises a body 10 formed of two substantially identical panels 12 which conform to the shape of a racket head. Each panel 12 is formed of an inner layer 28 and an outer layer 30. The inner layer 28 is formed of foam which deforms as necessary to comfortably accommodate the hand 24 and wrist 25. The outer layer 30 is formed of corrugated cardboard 20 to provide a firm surface for hitting a ball. As can be seen in the Figures, the outer layer 30 presents a hitting surface 14 which is substantially planar and resembles a racket face for striking a ball.

Figure 5:
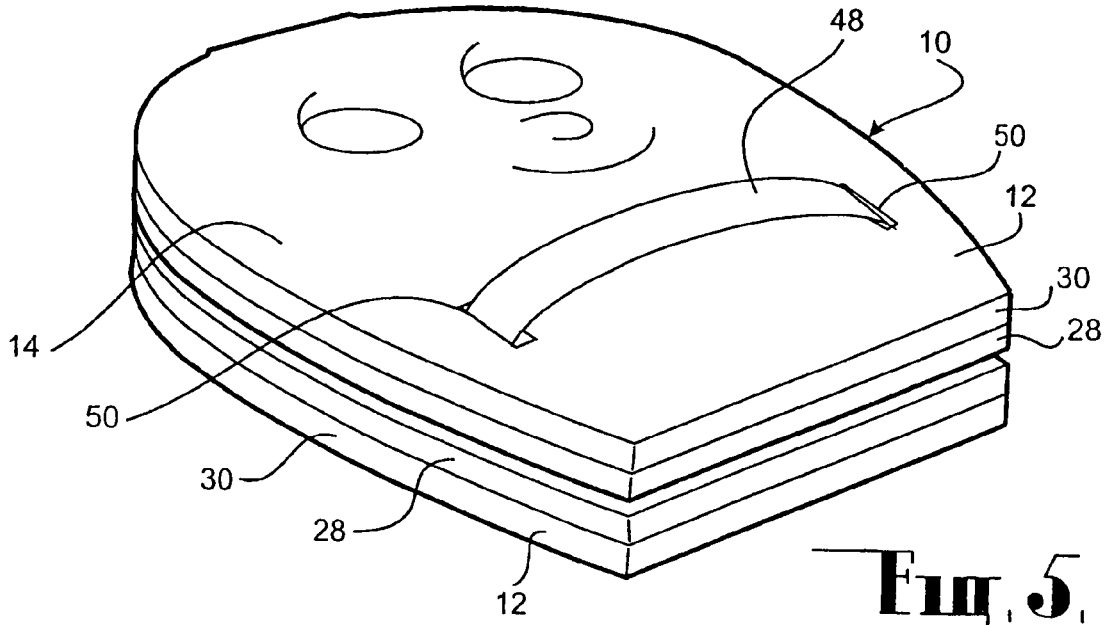
FIG. 5 shows the device of a second embodiment of the present invention in the closed position, as viewed from one end.
Figure 6:
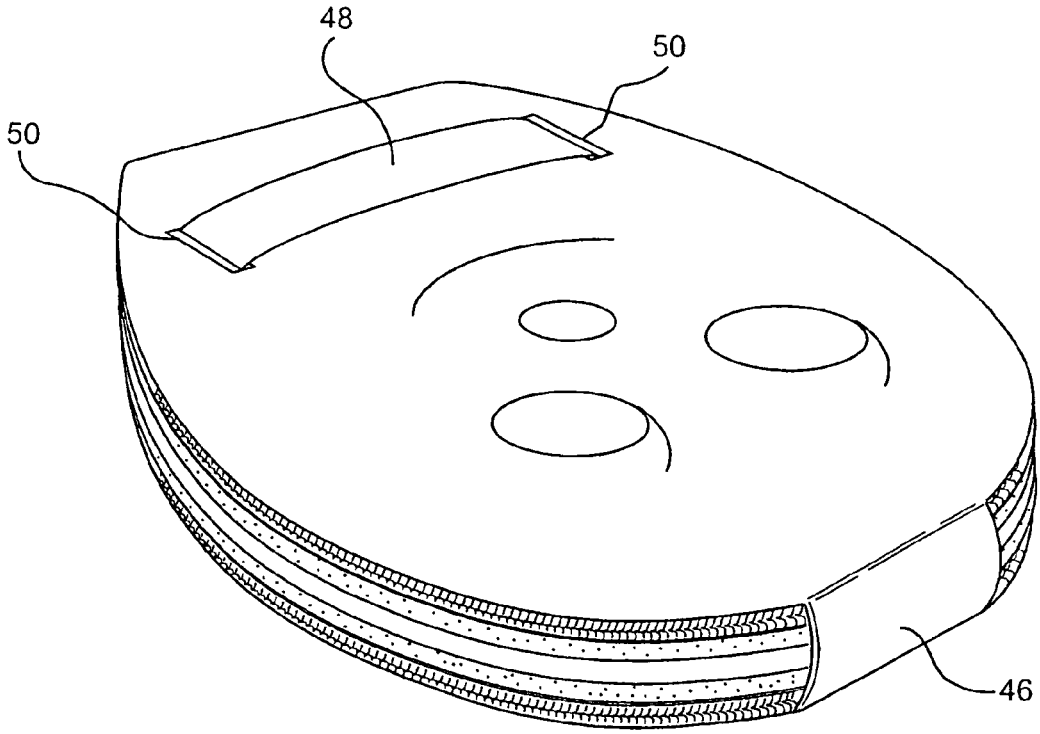
FIG. 6 shows the device of FIG. 5 as viewed from the other end.

The hitting surface is decorative as shown in FIGS. 5 and 6 (but omitted from FIGS. 7 to 10).

Since a main purpose of the device is as an aid in the teaching of racket sports, the shapes and sizes of the panels 12 are similar to those of a standard racket which is truncated at the lower end. In other variations, the panels 12 can be of any convenient shape and size, including in particular the shape and size of various types of squash or tennis rackets or the blade of a table tennis bat.

Figure 7:
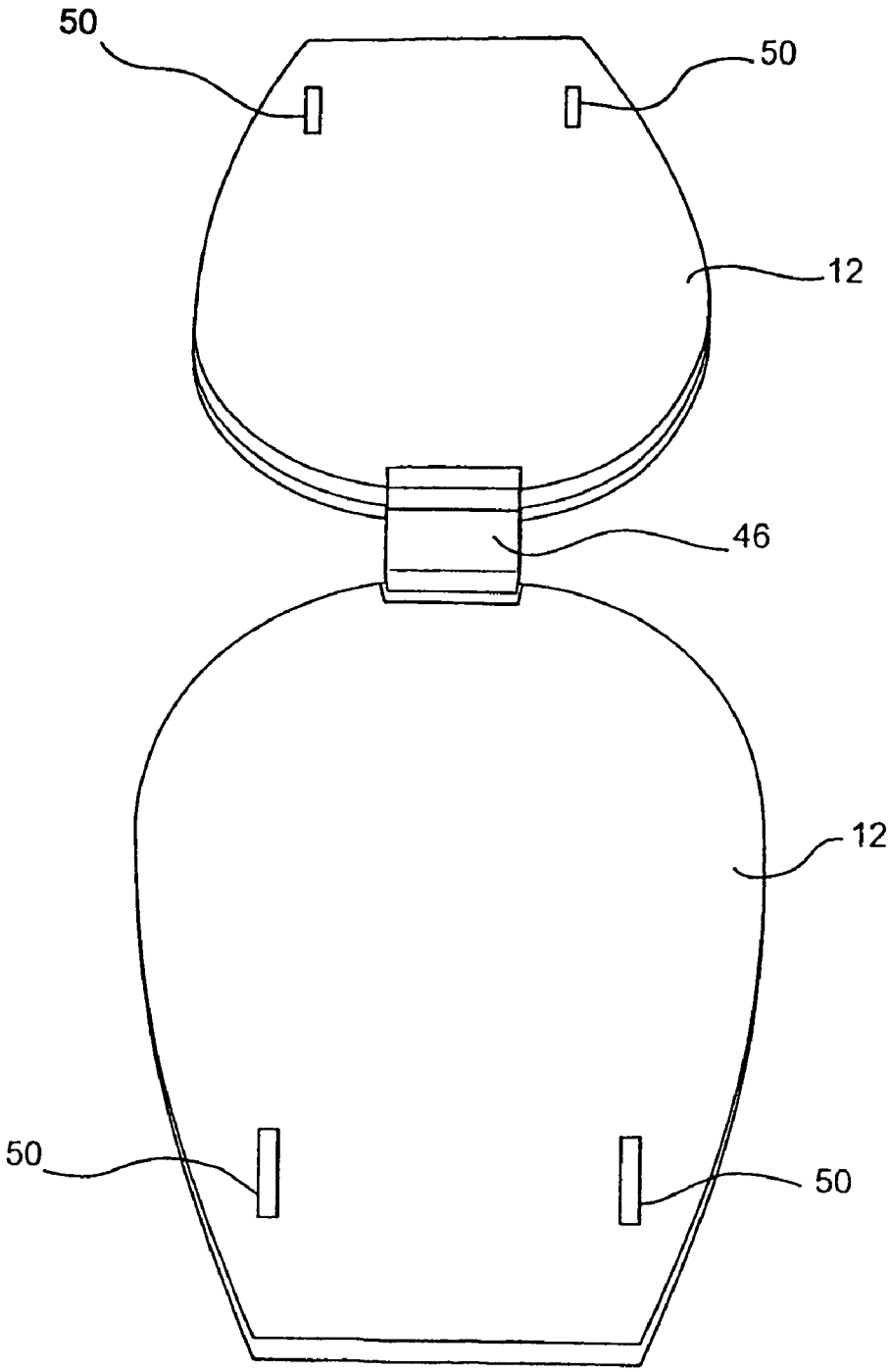
FIG. 7 shows the device of FIG. 5 in a fully opened position prior to having an elastic strap attached.
Figure 8A:
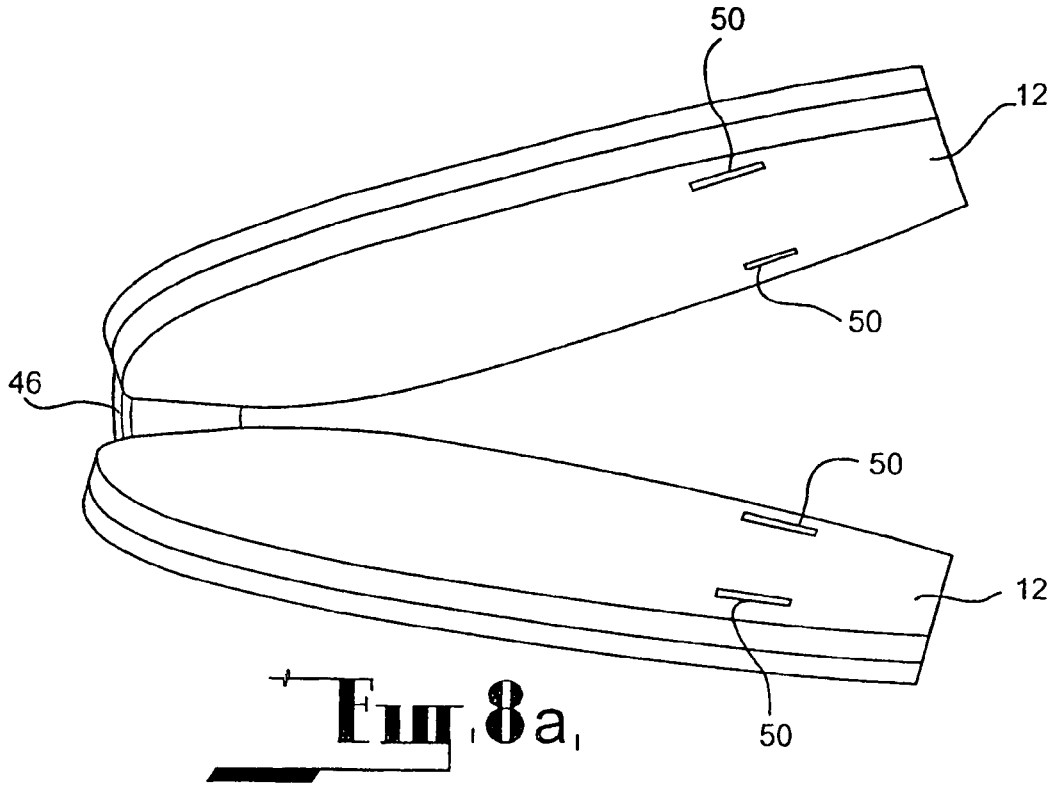
FIGS. 8*a* and 8*b* show the device of FIG. 5 in a partially opened position prior to having the elastic strap attached.
Figure 8B:
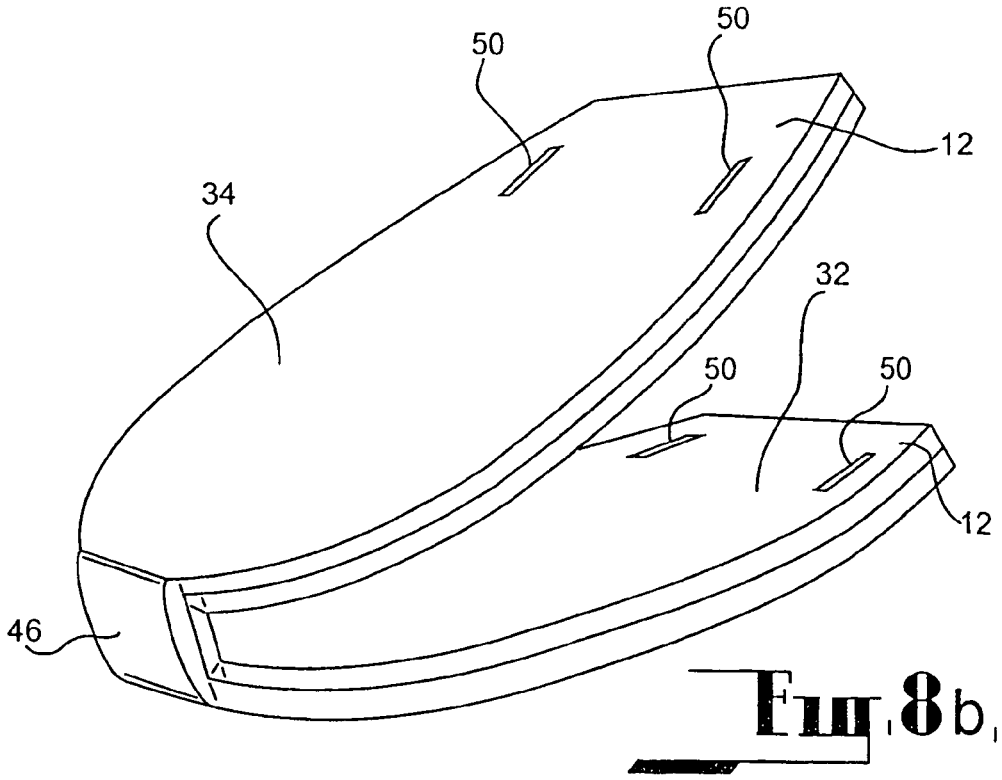
Figure 9A:
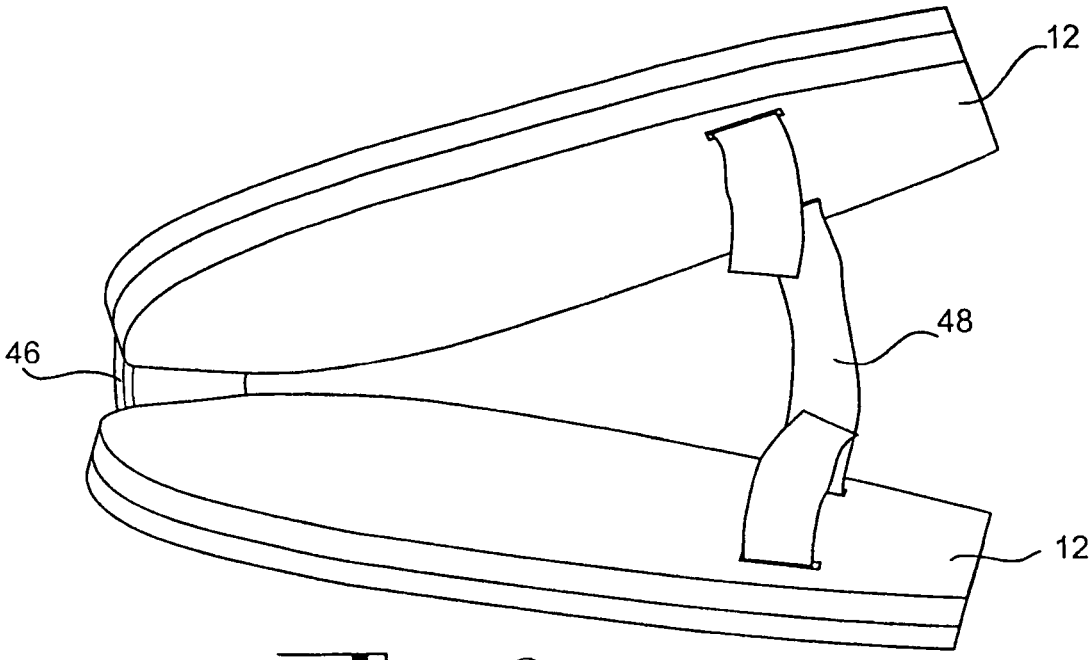
FIGS. 9*a* and 9*b* show the device of FIGS. 8*a* and 8*b* with the elastic strap in the process of being attached.
Figure 9B:
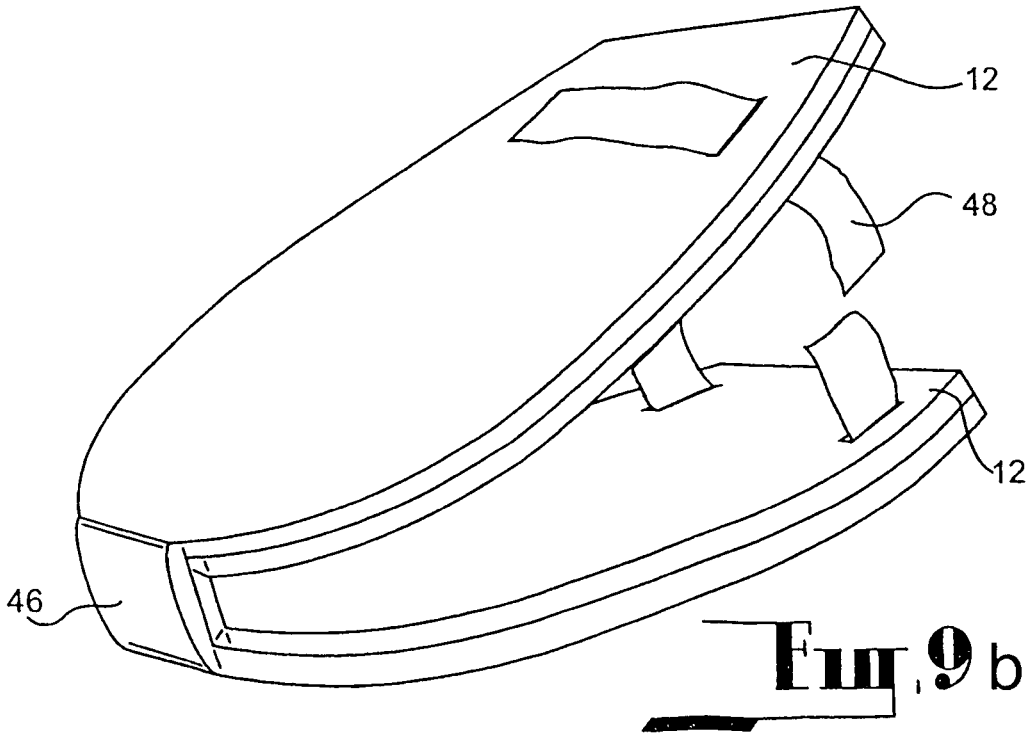

The device of the second embodiment further comprises at one end a hinge 46 to connect the two panels 12 to each other. The hinge 46 is in the form of cardboard and flexible tape. At the other end of the device an elastic strap 48 is provided which passes through a pair of apertures 50 on each panel 12 to provide a means for drawing the panels together about the hinge 46. FIGS. 7 and 8 show the device prior to inserting the elastic strap 48 through the apertures 50 and FIG. 9 shows the elastic strap 48 being passed through the apertures 50 prior to the ends thereof being secured to form the device ready for use.

Figure 10A:
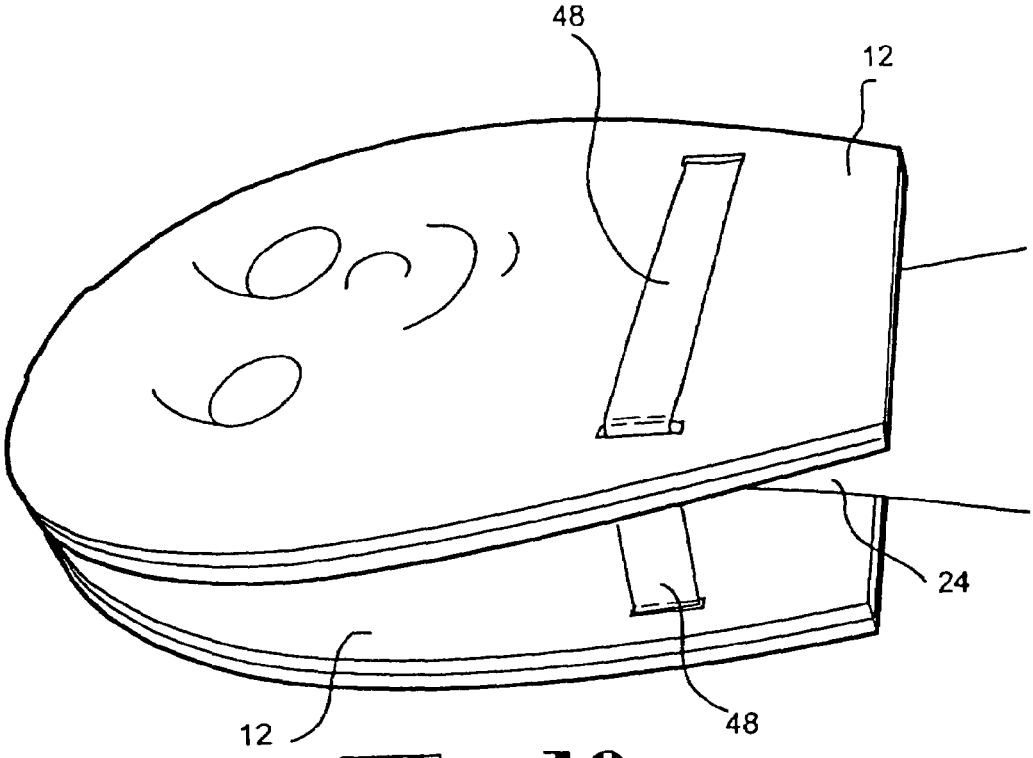
FIGS. 10*a* and 10*b* show the device of FIG. 5 in use, in place over a hand and wrist of a user.
Figure 10B:
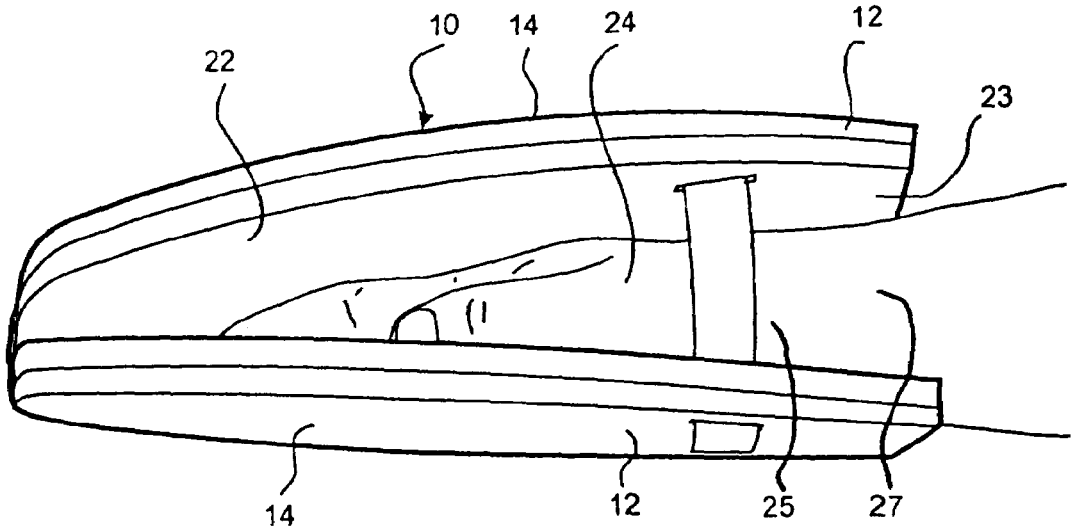
Figure 11:
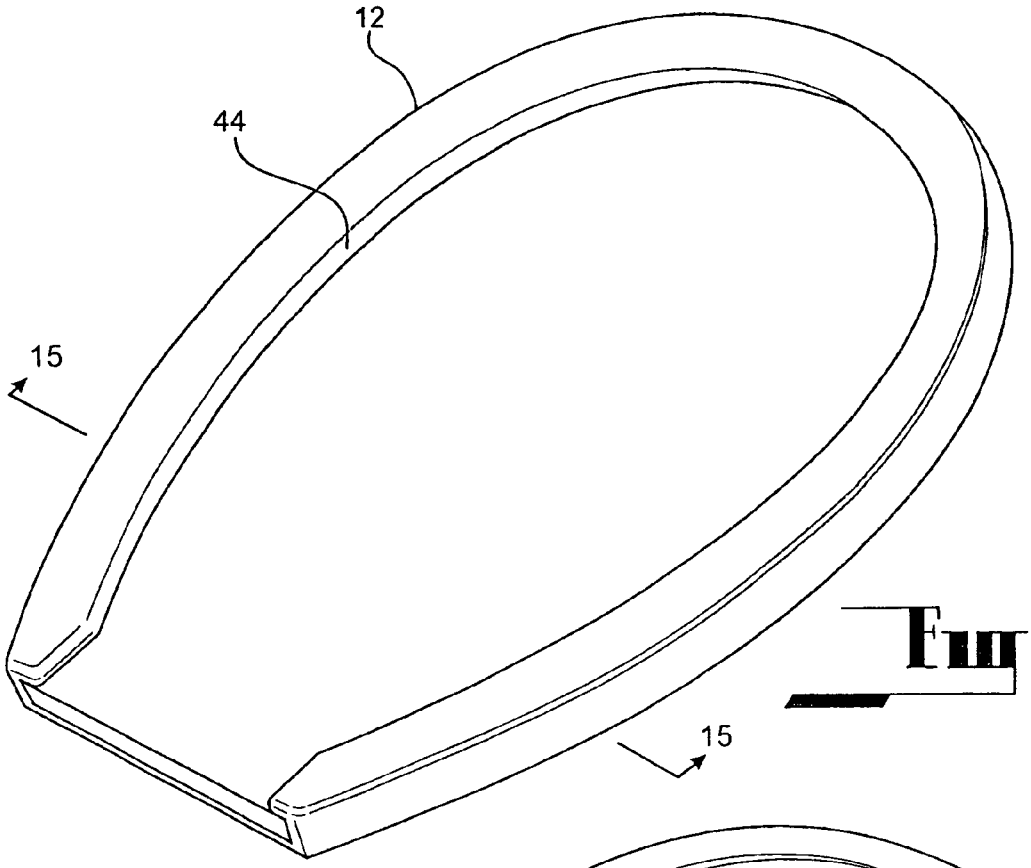
FIG. 11 shows a perspective view of a first panel of the device of a third embodiment of the present invention showing the inner face of the device prior to attachment of the connection means.
Figure 12:
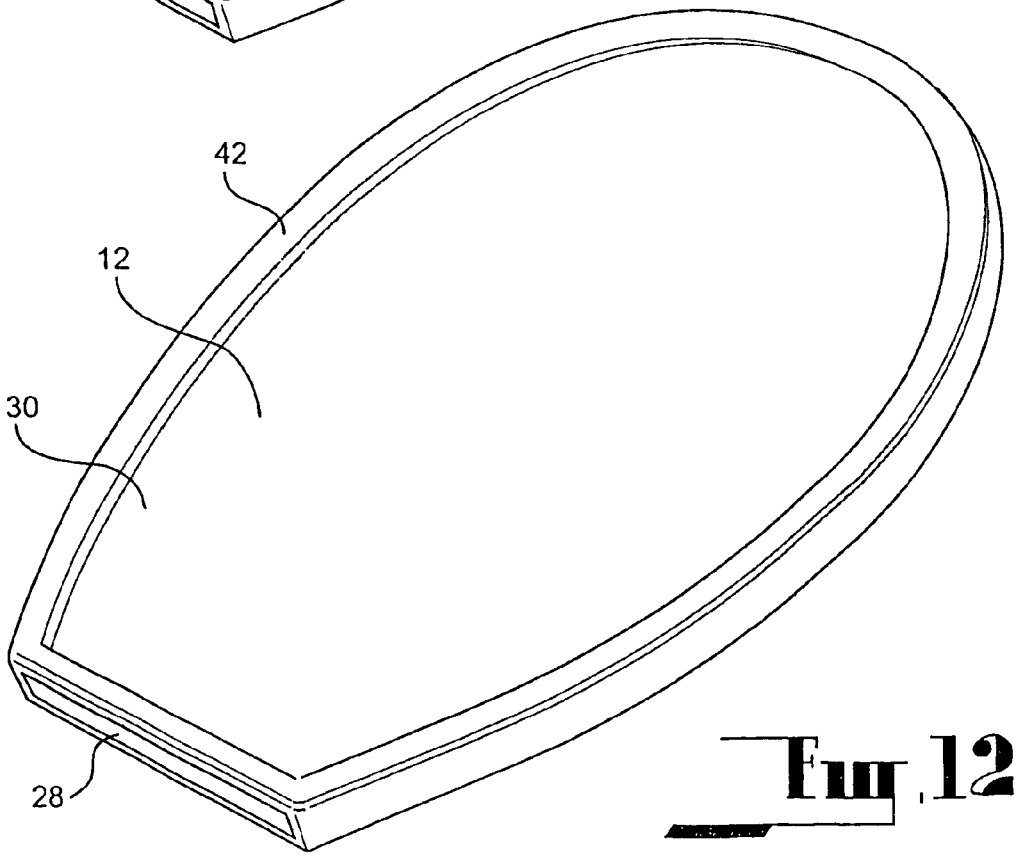
FIG. 12 shows a perspective view of the first panel of the device of FIG. 11 showing the outer face of the device.
Figure 13:
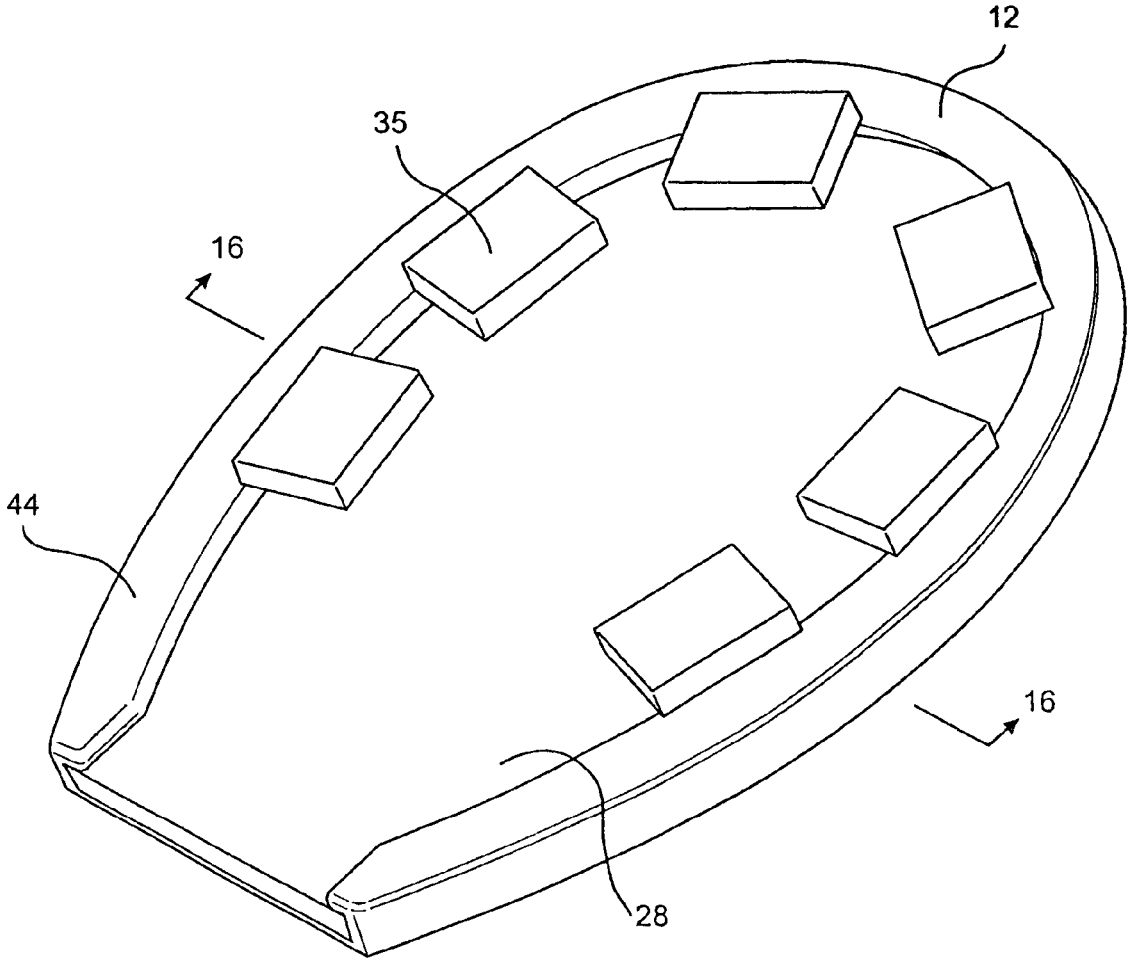
FIG. 13 shows a perspective view of the device of FIG. 11 after positioning of the connection means.
Figure 14:
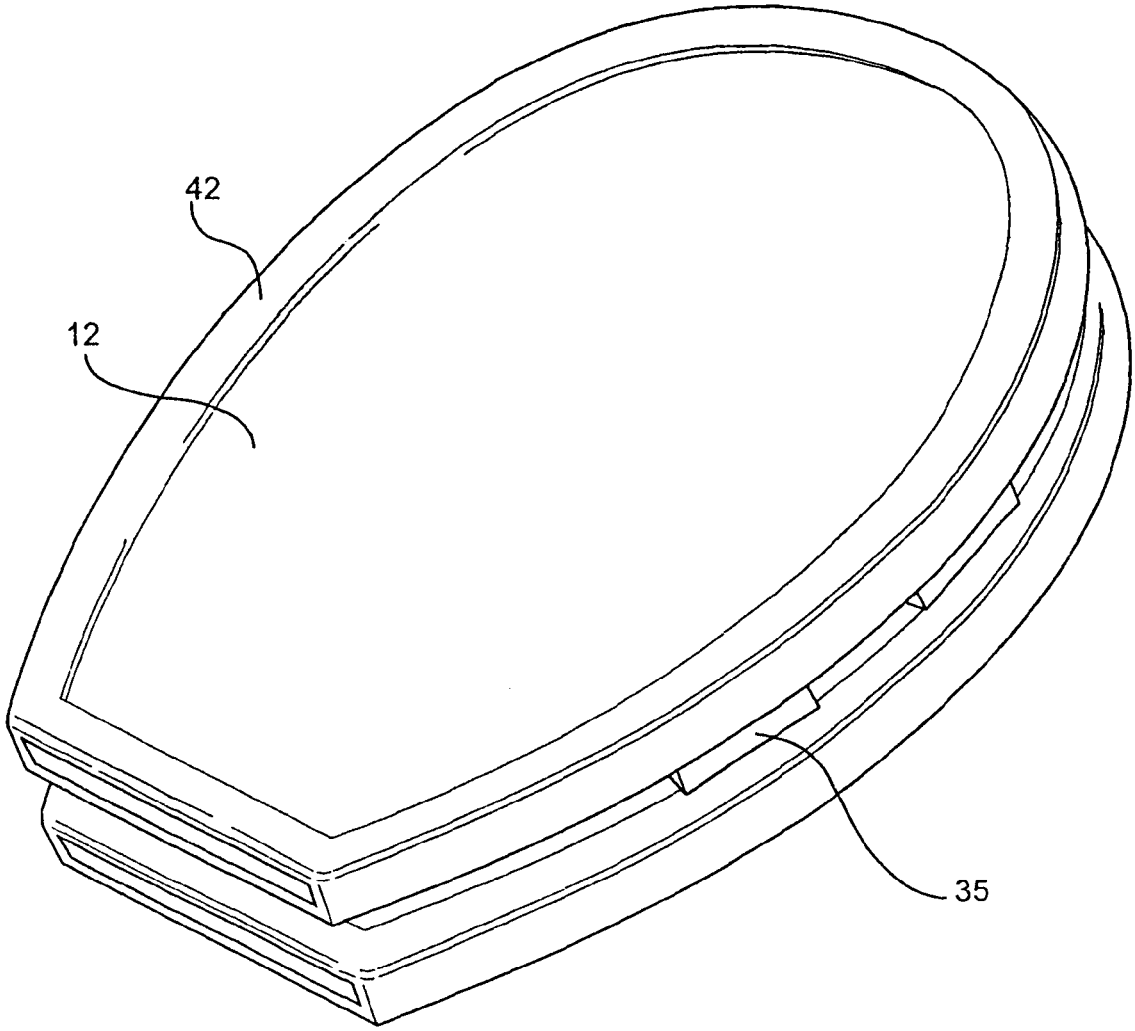
FIG. 14 shows a perspective view of the device of the third embodiment showing the first and second panels connected together ready for use.
Figure 15:
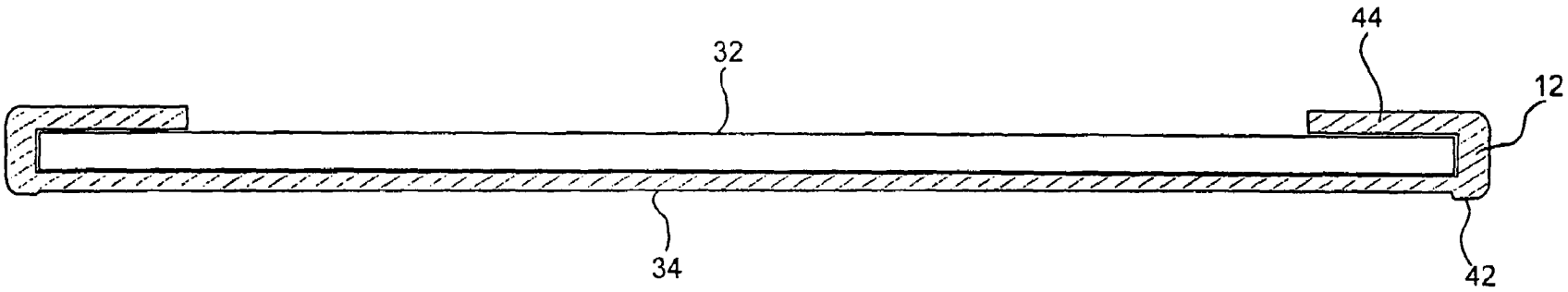
FIG. 15 shows a cross-sectional view through the panel of the device of FIG. 11 along line 15—15.

As can be seen in FIGS. 10*a* and 10*b*, the hand 24 is passed between the panels 12 by easing the elastic strap 48 so as to move the panels 12 away from each other to form the cavity 22. As can be noted, the panels 12 extend over the wrist 25 of the user which limits rotation at the wrist 25 perpendicular to the plane of the palm (or back) of the hand. As can be seen in FIG. 10*b*, the panels 12 of the second embodiment also extend over a portion of the forearm 27 of the user further assisting in encouraging movement of the arm from the shoulder to develop correct stroke technique.

Due to the adjustment of the spacing between the two panels 12 by means of the elastic strap 48, the device of the second embodiment can readily accommodate all sizes and shapes of hands and wrists.

Thus it can be seen that the two substantially planar hitting surfaces formed by the panels 12 are positioned over the palm and back of the hand and wrist when the device is in use. The hand is held flat with the fingers extended. The planes of the hitting surfaces, the palm and the back of the hand are in almost parallel alignment. Thus the distances from the point of impact with the ball to the point of application of force is minimised (and reduced to nearly zero) by eliminating the handle and making the point of impact almost coincident with the palm and back of the hand.

Furthermore, the panels 12 extend over the wrist and a portion of the forearm so that rotation about the wrist in a plane along the forearm perpendicular to the plane of the hand is inhibited.

The device of the third embodiment comprises an outer frame of rigid plastic with a flange 44 bounding the inner layer 28 and a raised periphery 42 bounding the outer layer 30. The flange 44 serves the purpose of providing a solid surface on which the connection means 35 can be attached. Furthermore, the flange 44 serves the purpose of retaining the foam which forms the major portion of the inner layer 28.

Figure 16A:
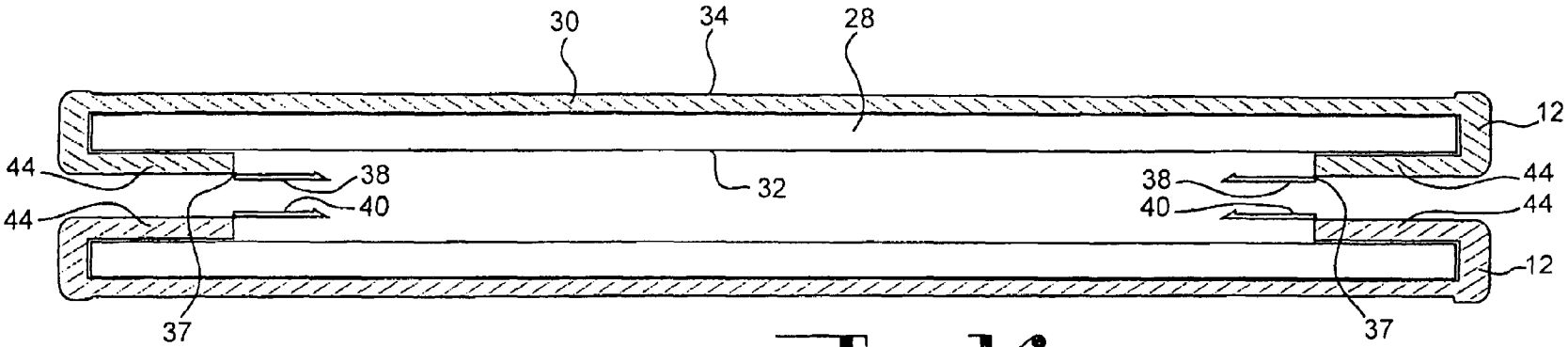
FIG. 16*a* shows a cross-sectional view through the first panel of FIG. 13 along line 16—16 together with a cross-sectional view through a second corresponding panel.
Figure 16B:
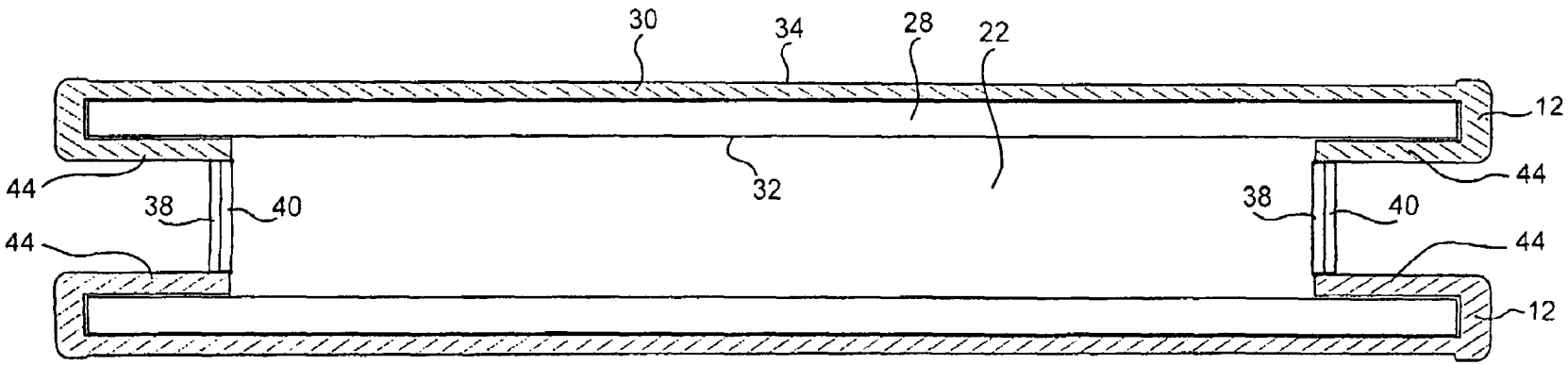
FIG. 16*b* shows a cross-sectional view when the first and second panels of 16*a* are connected together for use of the device.
Figure 17:
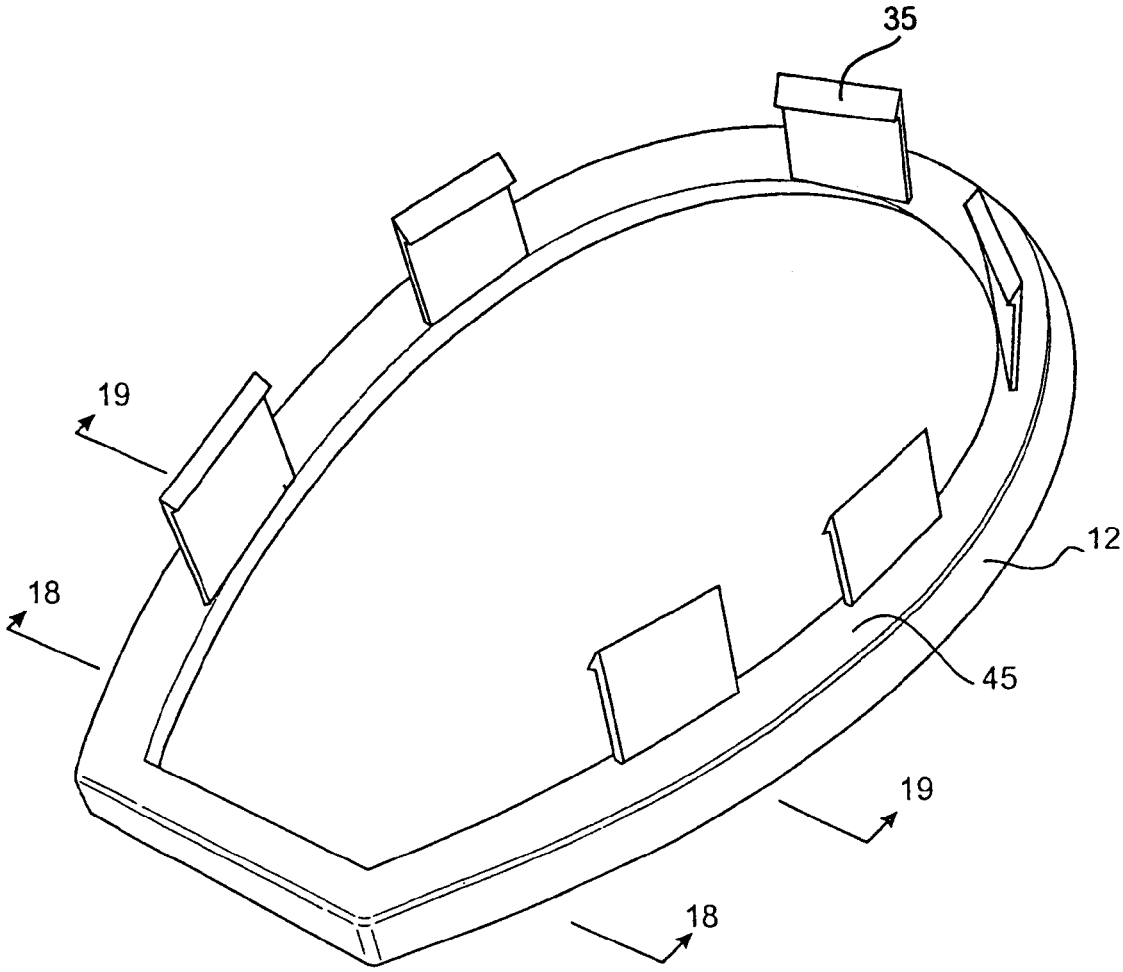
FIG. 17 shows a perspective view of a first panel of the device of a fourth embodiment of the present invention showing the connection means pivoted to an operative condition.
Figure 18:
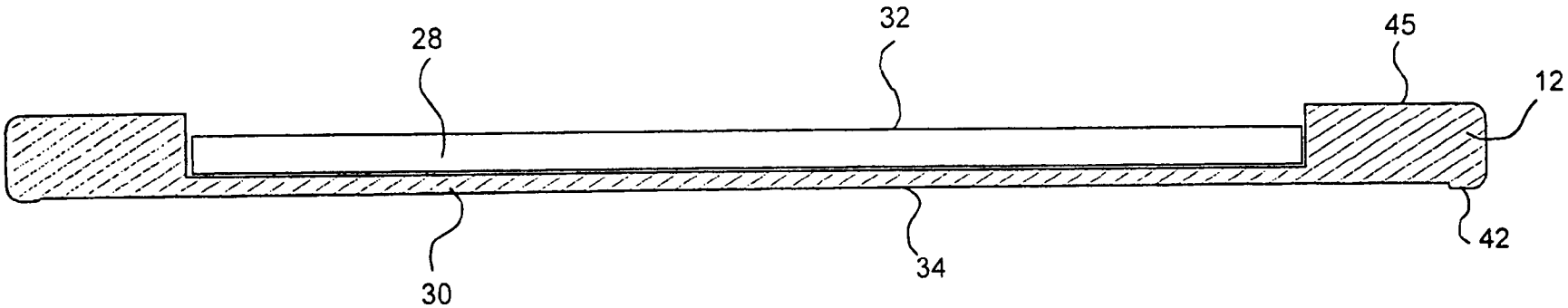
FIG. 18 shows a cross-sectional view of the device of the fourth embodiment of the present invention through the panel of the device of FIG. 17 along line 18—18.

As can be seen in FIGS. 16*a* and 16*b*, the connection means 35 comprises a set of first connection elements 38 and a set of second connection elements 40 which fit together in the device to be used as shown in FIG. 16*b*. The first and second connection elements are connected to the flange 44 at hinge point 37. This allows the first and second connection elements to be folded parallel to the panel for convenient storage. When the device is to be used, the first and second connection elements are raised about the hinge point 37 and connected together to form the device to be used as shown in FIG. 16*b*.

The device of the third embodiment also consists of two panels 12 which are connected together by means of the connection means 35. The connection means 35 may be height-adjustable so that the spacing between the two panels of the device may be adjusted to accommodate the appropriate hand size.

The first connection elements 38 and the second connection elements 40 are snap-fit connectors, the first elements being of male configuration and the second being of female configuration. In an alternative arrangement, the first connection elements may be a combination of male and female configured elements to correspond with matching male and female configured second connection elements.

Figure 19A:
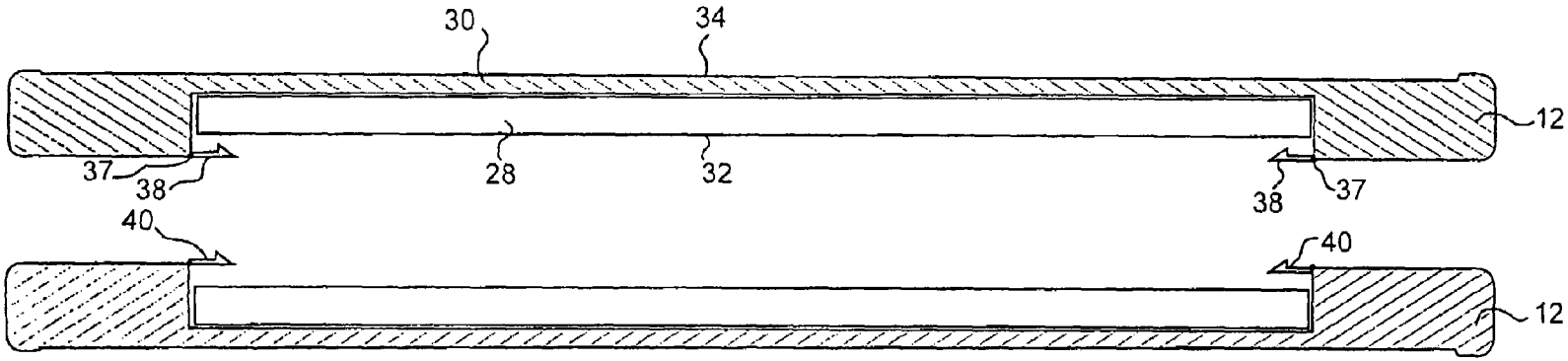
FIG. 19*a* shows a cross-sectional view of the device through the first panel of FIG. 17 along line 19—19 together with a cross-sectional view through a second corresponding panel, showing the connection elements pivoted to a stored condition.
Figure 19B:
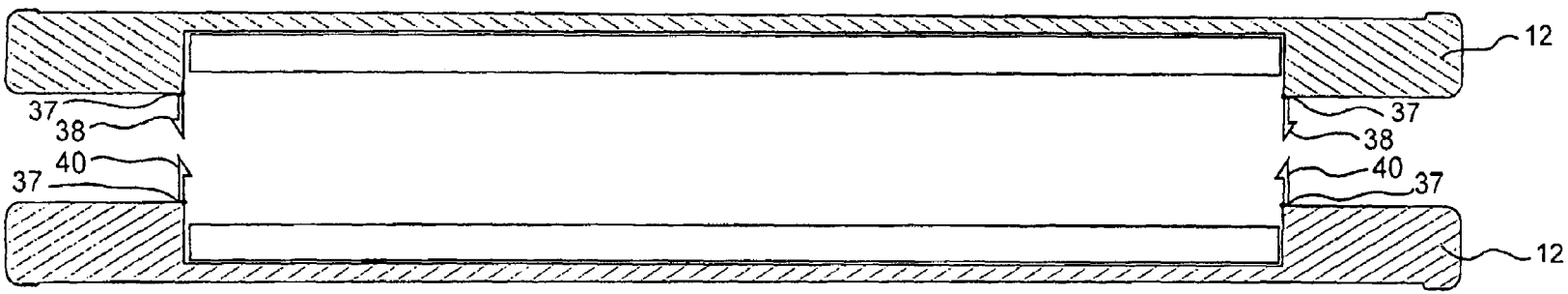
FIG. 19*b* shows a cross-sectional view of the device of FIG. 19*a* showing the connection elements pivoted to an operative condition.
Figure 20:
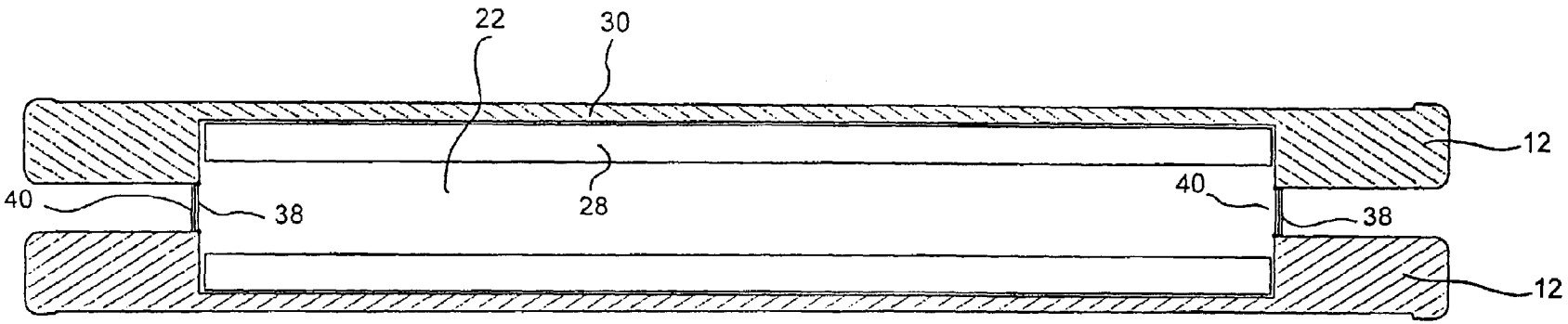
FIG. 20 shows a cross-sectional view of the device of FIG. 19*b* showing the two panels joined together by means of the connection elements for use of the device.

The device according to the fourth embodiment is similar in many respects to that of the third embodiment. However the device of the fourth embodiment does not comprise a flange 44 as in the case of the third embodiment but comprises a wall 45 on which are positioned the connection elements 35. The device of the fourth embodiment is also provided with first connection elements 38 and second connection elements 40 which fit together in a snap-fit arrangement as shown in FIGS. 19*a*, 19*b* and 20.

Figure 21:
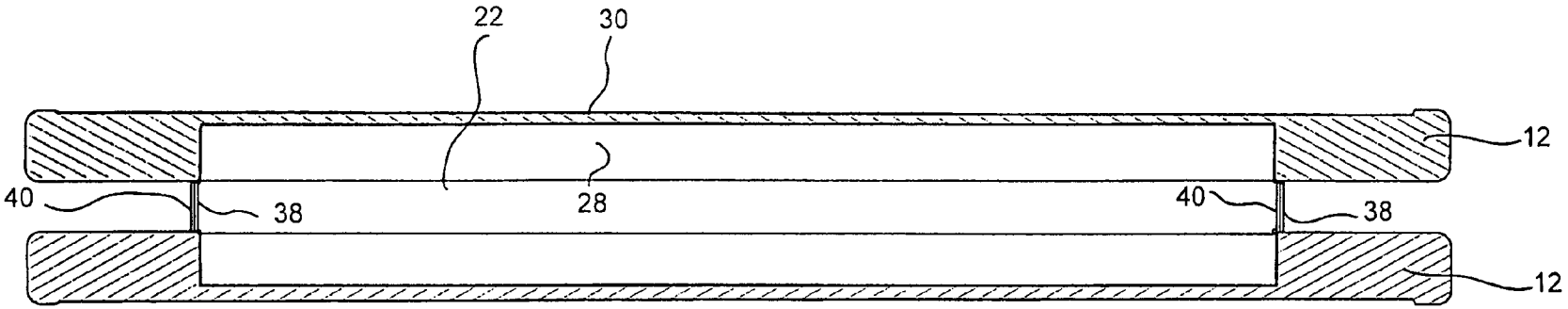
FIG. 21 shows a cross-sectional view of a device of the invention according to a fifth embodiment.
Figure 22:
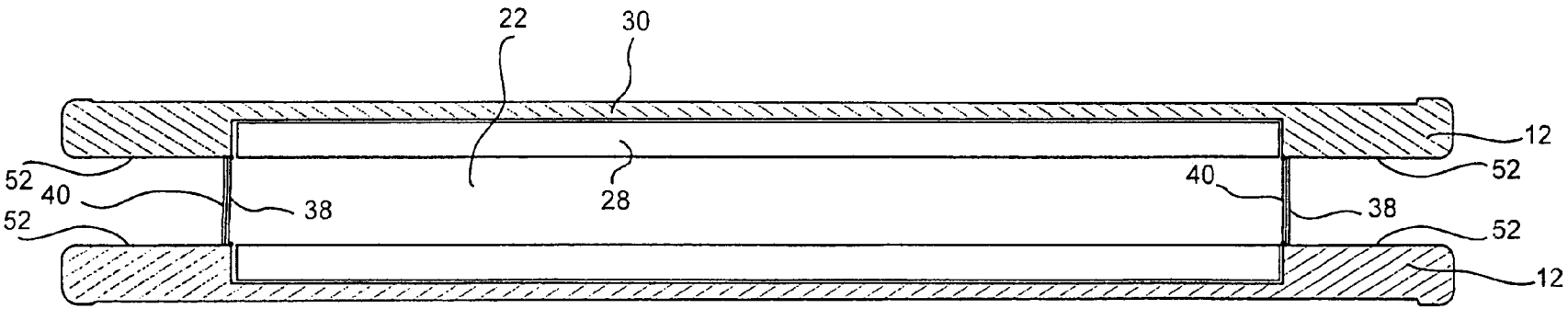
FIG. 22 shows a cross-sectional view of a device of the invention according to a sixth embodiment.

The relative thicknesses of the inner layer and the outer layer may be varied so as to vary the overall weight of the device as shown in the fifth and sixth embodiments. As shown in FIG. 21, the outer layer 30 is made of reduced thickness and the inner layer 28 is made of increased thickness relative to the embodiment shown in FIG. 20. Therefore, given that the outer layer 30 is provided of rigid plastic and the inner layer is of foam, the overall weight of the device shown in FIG. 21 will be less than the weight of the corresponding embodiment shown in FIG. 20. In another variation as shown in FIG. 22, portions of the outer layer 30 adjacent the connection elements 38 and 40 in the areas marked 52 have been reduced in size thereby reducing the overall weight of the device compared with the embodiment shown in FIG. 20.

Modifications and improvements may be made to the foregoing without departing from the scope of the present invention. Furthermore, it should be appreciated that the scope of the invention is not limited to the scope of the embodiments described.

Throughout the specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A ball game device comprising a body adapted to receive a hand and a wrist of a user, the body comprising a first panel defining a first hitting surface and a second panel defining a second hitting surface for hitting a ball, the second hitting surface opposed to the first hitting surface, and connection means for connecting the two panels together, and the body being configured to accommodate the hand and wrist of the user between the first hitting surface and the second hitting surface when the device is in use, to at least partly restrict movement of the wrist, wherein each panel is conformed to the size of a racket head so that each panel extends beyond the hand and wrist, or wherein each panel is conformed to the shape of a racket head, the body further comprising a cavity defined within the body to receive the hand and the wrist, the cavity being dimensioned so that the hand and the wrist of the user are positioned between the panels when the hand and the wrist are received in the cavity, the arrangement of the cavity being adaptable to accommodate a range of hand and wrist sizes, wherein the connection means comprises a plurality of spacers positioned around the periphery of the inner face of the first panel, and wherein said ball game device is supplied as a kit, said kit comprising:

material for forming the panels and spacers;

a template for cutting out the panels and spacers; and instructions for assembly of the device.

2. A ball game device according to claim 1 wherein the cavity is dimensioned so that a portion of the forearm adjacent the wrist is positioned between the panels when the hand and the wrist are received in the cavity.

3. A ball game device according to claim 1 wherein the cavity is configured as a mitt or a glove.

4. A ball game device according to claim 1 wherein each panel comprises an inner face and an outer face, and wherein each outer face presents the hitting surface to hit the ball.

5. A ball game device according to claim 4 wherein each panel comprises an inner layer and an outer layer, the outer layer comprising the outer face and the inner layer comprising the inner face.

6. A ball game device according to claim 5 wherein the outer layer is comprised of a rigid material and the inner layer is comprised of a flexible material.

7. A ball game device according to claim 6 wherein the rigid material is cardboard and the flexible material is foam.

8. A ball game device according to claim 6 wherein the rigid material is moulded plastic and the flexible material is foam.

9. A ball game device according to claim 4 wherein the first or each outer face is bounded by a raised periphery.

10. A ball game device according to claim 1 wherein the first panel and the second panel are connected in spaced apart relationship to define the cavity therebetween.

11. A ball game device according to claim 1 wherein the connection means is adapted to maintain the panels in spaced apart relationship.

12. A ball game device according to claim 1 wherein the connection means is positioned on the inner face of the first panel and is adapted for connection to the second panel in an arrangement to allow an opening in the cavity between the first and second panels for insertion of the hand and wrist.

13. A ball game device according to claim 1 wherein the connection means comprises a snap-fit connector.

14. A ball game device according to claim 1 wherein the connection means is hinged to the inner face of the or each panel for pivotal movement between an operative and a stored condition.

15. A ball game device according to claim 1 wherein the inner face further comprises a flange of rigid material to present a solid surface on which to attach the connection means.

16. A ball game device according to claim 1 wherein the connection means comprises a set of first connection elements on the first panel and a set of second connection elements on the second panel, the first and second connection elements being adapted to be connected together to connect the first and second panels together in spaced apart relationship to define the cavity.

17. A ball game device according to claim 16 wherein the first connection elements can be pivoted between operative and stored conditions and the second connection elements can be similarly pivoted.

18. A ball game device according to claim 1 wherein the spacers are dimensioned so that a first end of the first panel is maintained at a first distance from a first end of the second panel and so that a second end of the first panel is maintained at a second distance from a second end of the second panel, the second distance being greater than the first distance.

19. A ball game device according to claim 18 wherein the opening between the first and second panels is positioned at the second ends of the first and second panels so that the device tapers towards the first ends of the first and second panels.

20. A ball game device according to claim 1 wherein the connection means comprises hinge means and a means for drawing the panels together about the hinge.

21. A ball game device according to claim 20 wherein the means comprises an adjustable strap system.

22. A ball game device according to claim 1 wherein the kit further comprises instructions for games to be played with the device.

23. A ball game device according to claim 1 wherein the kit further comprises a ball or balls for use with the device.

24. A ball game device comprising a substantially racket-head shaped device adapted to fit over a user's hand and wrist in a glove-like manner, to provide a teaching device for racket sports which moves directly with the hand to allow the user readily to hit a ball, the device comprising two opposed panels and a cavity in a space defined by the opposed panels, the cavity being dimensioned so that the hand and the wrist of the user are positioned between the panels when the hand and the wrist are received in the cavity, the arrangement of the cavity being adaptable to accommodate a range of hand and wrist sizes, wherein the device is supplied in a kit form, the kit comprising:

thirty 5 mm thick cardboard pieces, including two rectangular pieces of width 22 cm and length 30 cm (from which are cut the panels of the device), and twenty-eight strips of width 2 cm and length 6 cm (the spacers of the device);

an instruction booklet for assembly of the device;

a template for cutting out the panels of the device; and instructions for games to be played with the device.

25. A ball game device according to claim 24 wherein the two panels are conjoined at a first end by a hinge and at a second end by an elastic strap, the construction allowing the user to slide the hand and the wrist into the cavity in a glove-like manner between the two panels.

* * * * *